US007365709B2

(12) United States Patent
Kim et al.

(10) Patent No.: US 7,365,709 B2
(45) Date of Patent: Apr. 29, 2008

(54) PLASMA DISPLAY PANEL DRIVER

(75) Inventors: Jin-Sung Kim, Cheonan-si (KR); Woo-Joon Chung, Asan-si (KR); Kyoung-Ho Kang, Suwon-si (KR); Seung-Hun Chae, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 696 days.

(21) Appl. No.: 10/872,496

(22) Filed: Jun. 22, 2004

(65) Prior Publication Data

US 2005/0024294 A1 Feb. 3, 2005

(30) Foreign Application Priority Data

Jun. 23, 2003 (KR) ..... 10-2003-0040689

(51) Int. Cl.
*G09G 3/28* (2006.01)

(52) U.S. Cl. ..... 345/60; 345/62; 345/63; 345/211

(58) Field of Classification Search ..... 345/60, 345/62, 63, 211
See application file for complete search history.

(56) References Cited

U.S. PATENT DOCUMENTS 5,745,086 A 4/1998 Weber ..... 345/63
6,882,644 B1 * 4/2005 Bendak et al. ..... 370/390
7,151,510 B2 * 12/2006 Whang et al. ..... 345/66

* cited by examiner

*Primary Examiner*—Richard Hjerpe
*Assistant Examiner*—Leonid Shapiro
(74) *Attorney, Agent, or Firm*—H. C. Park & Associates, PLC

(57) ABSTRACT

A panel capacitor is formed by a scan electrode and a sustain electrode. The voltage at the panel capacitor is reduced by turning on a transistor coupled between the scan electrode and the capacitor. As a result, the voltage within the panel capacitor exceeds the discharge firing voltage to discharge the panel capacitor. When the gate voltage of the transistor is reduced by an RC circuit, the transistor is turned off, and the scan electrode is floated. A discharge is then steeply quenched, and wall charges are finely controlled. Next, the above-noted operation is repeated by turning on the transistor.

12 Claims, 8 Drawing Sheets

PLASMA DISPLAY PANEL DRIVER

This application claims the benefit of Korean Patent Application No. 2003-40689, filed on Jun. 23, 2003, which is hereby incorporated by reference for all purposes as if fully set forth herein.

BACKGROUND OF THE INVENTION

1. Field of the Invention

The present invention relates to a plasma display panel (PDP) driver and a method for driving a PDP.

2. Discussion of the Related Art

A PDP is a flat panel display (FPD) for displaying characters or images using the plasma generated by gas discharge, where millions of pixels may be arranged in a matrix format in the PDP according to the PDP's size. The PDP is classified as a direct current (DC) PDP or an alternating current (AC) PDP depending on waveforms of applied driving voltages and configurations of discharge cells.

In general, the AC PDP driving method uses a reset period, an address period, and a sustain period with respect to temporal operation variations.

During the reset period, wall charges formed by a previous sustain operation are erased, and cells are reset so as to fluently perform a next address operation. During the address period, cells to be turned on are selected, and the wall charges are accumulated on the turned-on cells (i.e., addressed cells). During the sustain period, a discharge for displaying images to the addressed cells is executed. When the sustain period starts, sustain pulses are alternately applied to the scan electrodes and sustain electrodes to thus perform sustaining and displaying the images.

Conventionally, a ramp waveform is applied to a scan electrode so as to establish wall charges in the reset period, as disclosed in U.S. Pat. No. 5,745,086. That is, a gradually rising ramp waveform is applied to the scan electrode, and then a gradually falling ramp waveform is applied thereto. Since control precision on the wall charges greatly depends on the gradient of the ramp when applying these ramp waveforms, the wall charges are not finely controlled within a predetermined time frame under the scheme disclosed in the U.S. Pat. No. 5,745,086.

SUMMARY OF THE INVENTION

Accordingly, the present invention is directed to a PDP driver and a method for driving a PDP that substantially obviates one or more of the problems due to limitations and disadvantages of the related art.

The present invention provides PDP driving circuits and a method for precisely controlling wall charges.

One aspect of the present invention provides a PDP driver comprising a transistor having a first main end coupled to a capacitive load, a second main end coupled to a power source, and a control end. A control end voltage control circuit is coupled between a control signal voltage source and the control end of the transistor, wherein the control signal voltage source alternately generates a control signal of a first level and of a second level, and transmits the control signal to the control end voltage circuit. The control end voltage control circuit, in response to the control signal of the first level, applies a first voltage on the control end of the transistor to turn on the transistor and then changes the voltage on the control end of the transistor to a second voltage for turning off the transistor within a predetermined period after the control signal of the first level is applied.

This present invention also provides a method for driving a PDP. It comprises applying a first voltage to a control end of a transistor that turns on the transistor in response to a control signal of a first level; changing the first voltage at the control end of the transistor to a second voltage at the control end of the transistor that turns off the transistor; and applying a third voltage to the control end of the transistor for maintaining the transistor in a turned off state in response to the control signal of a second level, wherein the control signal alternately has the first level and the second level.

This present invention also provides a PDP driver comprising a transistor having a first main end coupled to ground, a second main end coupled to a capacitive load, a control end, and a parasitic capacitor formed between the control end and the first main end. A control end voltage control circuit is coupled between a control signal voltage source and the control end of the transistor, wherein the control signal voltage source alternately generates a control signal of a first level and of a second level, and transmits the control signal to the control end voltage control circuit. A control end voltage control circuit, in response to the control signal of the first level, applies a first voltage on the control end of the transistor to turn on the transistor, and then changes the voltage on the control end of the transistor to a second voltage for turning off the transistor within a predetermined period after the control signal of the first level is applied. It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Reference will now be made in detail to an embodiment of the present invention, example of which is illustrated in the accompanying drawings. In the following detailed description, only the preferred embodiment of the invention has been shown and described, simply to illustrate the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

A PDP apparatus and a method for driving the PDP according to an exemplary embodiment of the present invention will now be described with reference to drawings.

Figure 1:
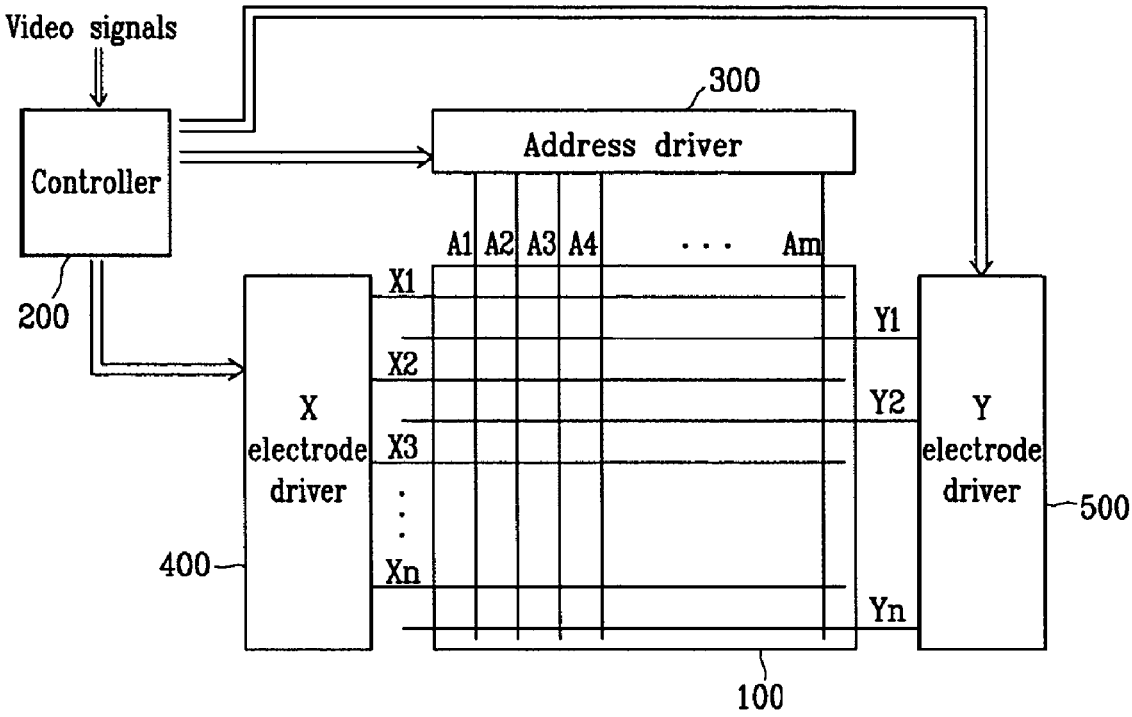
FIG. 1 shows a brief diagram of a PDP apparatus according to one exemplary embodiment of the present invention.

FIG. 1 shows a brief diagram of a PDP apparatus according to the exemplary embodiment of the present invention.

As shown, the PDP apparatus comprises a PDP 100, a controller 200, an address driver 300, a sustain electrode driver (referred to as an X electrode driver hereinafter) 400, and a scan electrode driver (referred to as a Y electrode driver hereinafter) 500.

The PDP 100 comprises a plurality of address electrodes A1 through Am arranged in the column direction, a plurality of sustain electrodes (referred to as X electrodes hereinafter) X1 through Xn arranged in the row direction, and a plurality of scan electrodes (referred to as Y electrodes hereinafter) Y1 through Yn arranged in the row direction. The X electrodes X1 through Xn are formed corresponding to the respective Y electrodes Y1 through Yn, and their ends are coupled in common. The PDP 100 includes a first glass substrate (not illustrated) on which the X and Y electrodes are arranged, and a second glass substrate (not illustrated) on which the address electrodes are arranged. The two glass substrates face each other with a discharge space there between so that the Y electrodes Y1 through Yn may cross the address electrodes A1 through Am and the X electrodes X1 through Xn may cross the address electrodes A1 through Am. In this case, discharge spaces on the crossing points of the address electrodes A1 through Am and the X and Y electrodes X1 through Xn and Y1 through Yn form discharge cells.

The controller 200 receives external video signals, and transmits driving control signals to the address, X, and Y electrodes. Also, the controller 200 divides a single frame into a plurality of subfields and drives them, and each subfield includes a reset period, an address period, and a sustain period with respect to temporal operation variations.

The address driver 300 receives address driving control signals from the controller 200, and applies display data signals for selecting desired discharge cells to the respective address electrodes A1 through Am. The X electrode driver 400 receives X electrode driving control signals from the controller 200, and applies driving voltages to the X electrodes X1 through Xn, and the Y electrode driver 500 receives Y electrode driving control signals from the controller 200, and applies driving voltages to the Y electrodes Y1 through Yn.

Figure 2:
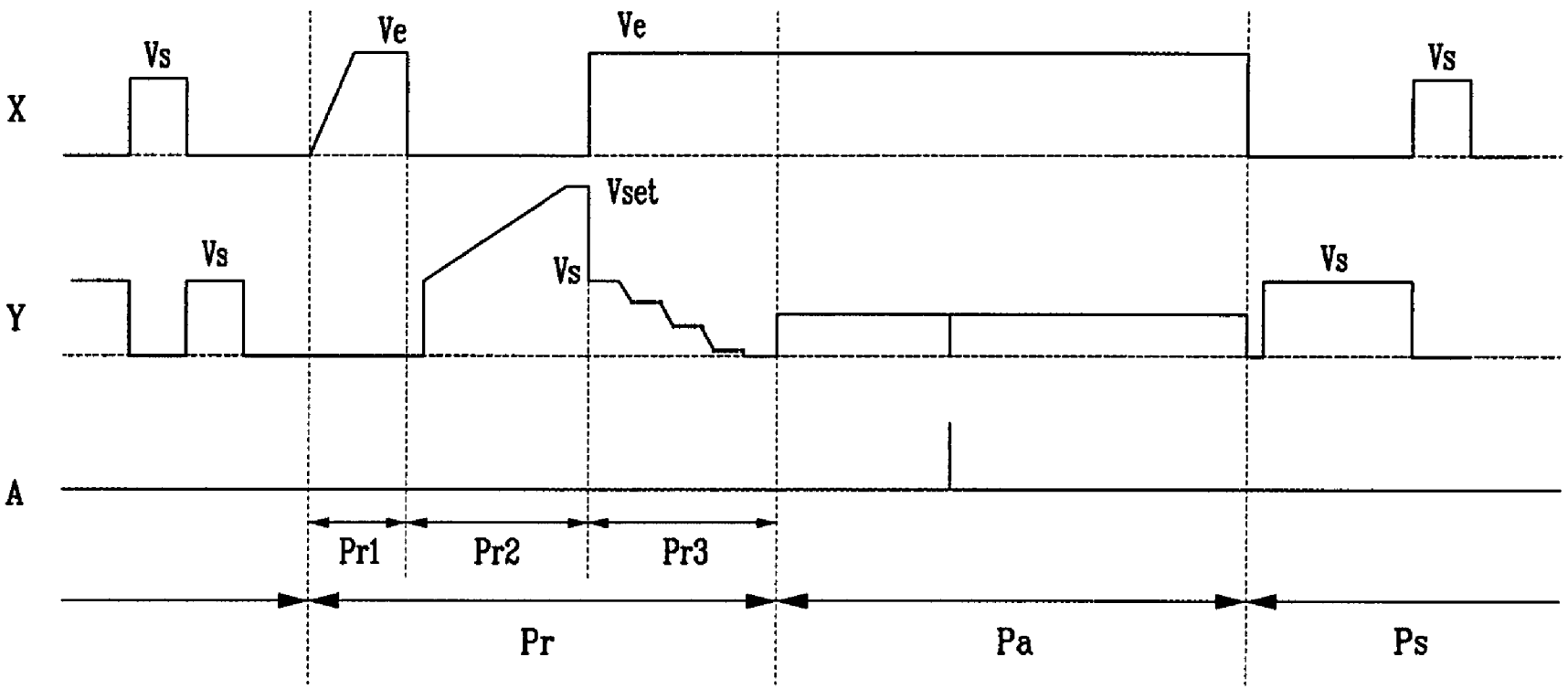
FIG. 2 shows a driving waveform diagram of the PDP according to the exemplary embodiment of the present invention.
Figure 3:
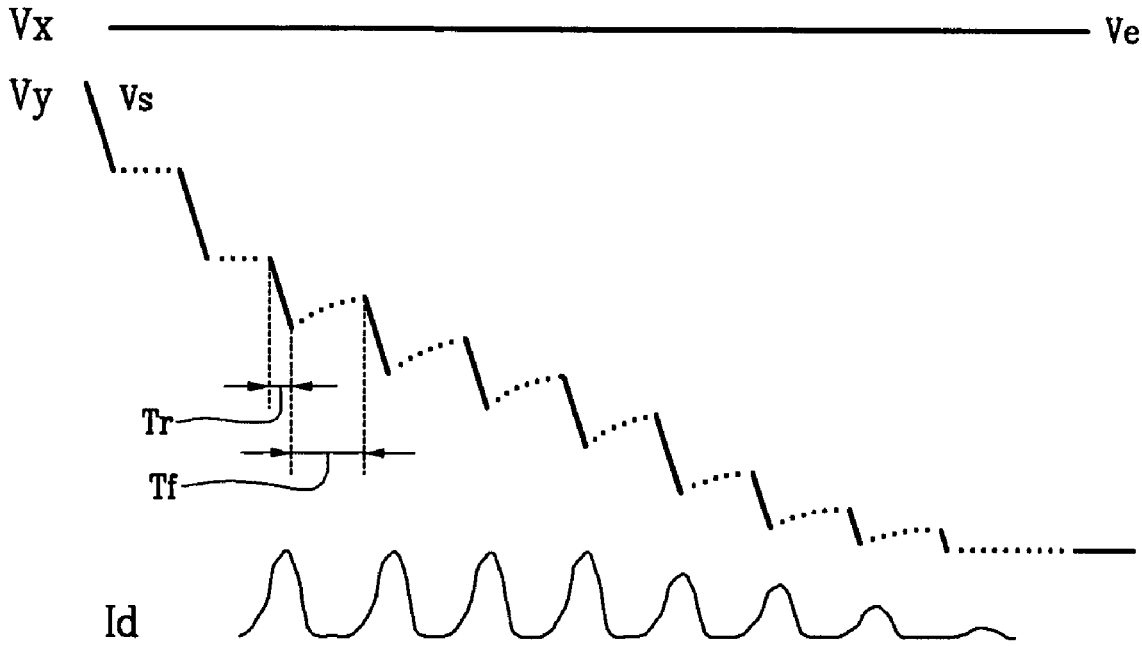
FIG. 3 shows a rising ramp waveform and a discharge current according to the exemplary embodiment of the present invention.

Referring to FIGS. 2 and 3, driving waveforms applied to the address electrodes A1 through Am, the X electrodes X1 through Xn, and the Y electrodes Y1 through Yn for each subfield will be described. A discharge cell formed by an address electrode, an X electrode, and a Y electrode will be described below.

FIG. 2 shows a driving waveform diagram of the PDP according to an exemplary embodiment of the present invention, and FIG. 3 shows a rising ramp waveform and a discharge current according to an exemplary embodiment of the present invention.

Referring to FIG. 2, a single subfield includes a reset period Pr, an address period Pa, and a sustain period Ps, and the reset period Pr includes an erase period Pr1, a rising ramp period Pr2, and a falling ramp period Pr3.

In general, positive charges are formed at the X electrode, and negative charges are formed at the Y electrode when the last sustaining is finished in a sustain period. In the erase period Pr1, a ramp waveform rising from a reference voltage to a voltage of Ve is applied to the X electrode, while the Y electrode is maintained at the reference voltage, assuming that the reference voltage is 0V (volts). The charges accumulated at the X and Y electrodes are gradually erased.

Next, in the rising ramp period Pr2, a ramp waveform rising from a voltage of Vs to a voltage of Vset is applied to the Y electrode while the X electrode is maintained at 0V. Weak resetting is generated to the address electrode and the X electrode from the Y electrode, and negative charges are accumulated at the Y electrode, and positive charges are accumulated at the address electrode and the X electrode.

As shown in FIGS. 2 and 3, in the falling ramp period Pr3, a falling/floating voltage is applied to the Y electrode for repeating a process wherein the voltage Vs is reduced by a predetermined voltage and floated until Vy reaches the reference voltage, while the X electrode is maintained at voltage Ve. That is, the voltage applied to the Y electrode is rapidly reduced during the period of Tr, and stopped during the period of Tf, thereby floating the Y electrode. The periods Tr and Tf are then repeated.

When the difference between the voltage Vx at the X electrode and the voltage Vy at the Y electrode becomes greater than a discharge firing voltage Vf while repeating the periods Tr and Tf, a discharge occurs between the X and Y electrodes. That is, a discharge current Id flows in the discharge space. When the Y electrode is floated after the discharge begins between the X and Y electrodes, the wall charges formed at the X and Y electrodes are reduced, the voltage within the discharge space is steeply reduced, and strong discharge quenching is generated within the discharge space. When a falling voltage is applied to the Y electrode to form a discharge and float the Y electrode, the wall charges are reduced, and strong discharge quenching is generated within the discharge space. When applying the falling voltage and floating the Y electrode are repeated a predetermined number of times, desired amounts of wall charges are formed at the X and Y electrodes.

In this case, it is desirable for the falling voltage applying period Tr to be short so as to appropriately control the wall charges. That is, the longer period Tr for applying the voltage generates more discharges, increasing the amount of wall charges to be controlled by a single discharge and floating. When the amount of wall charges increases as described, it is impossible to desirably control them.

Referring to FIGS. 4A through 4E, the strong discharge quenching caused by floating will be described below in detail with reference to the X and Y electrodes in the discharge cell, since the discharge generally occurs between the X and Y electrodes.

Figure 4A:
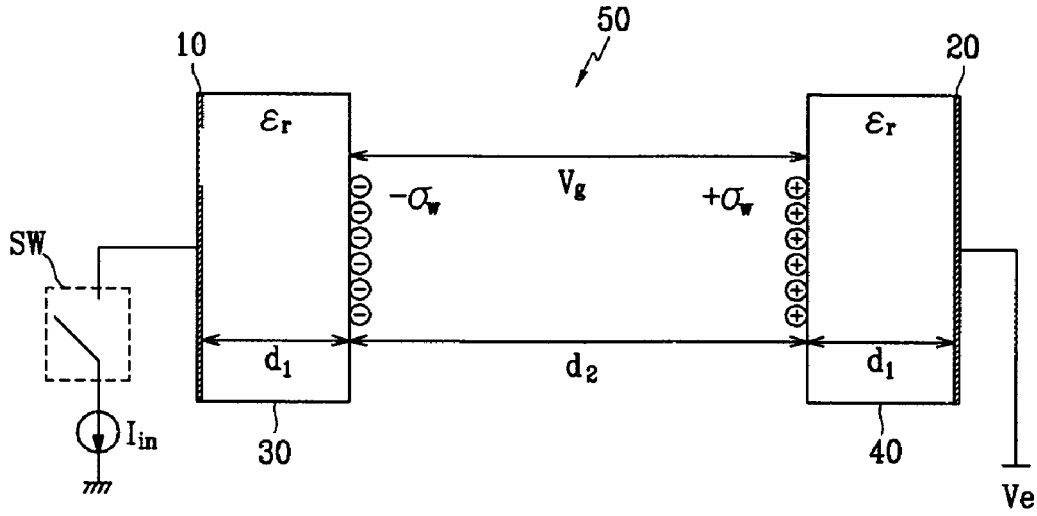
FIG. 4A shows a modeled diagram of a discharge cell formed by a sustain electrode and a scan electrode.
Figure 4B:
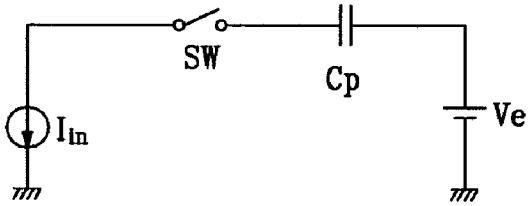
FIG. 4B shows an equivalent circuit of FIG. 4A.
Figure 4C:
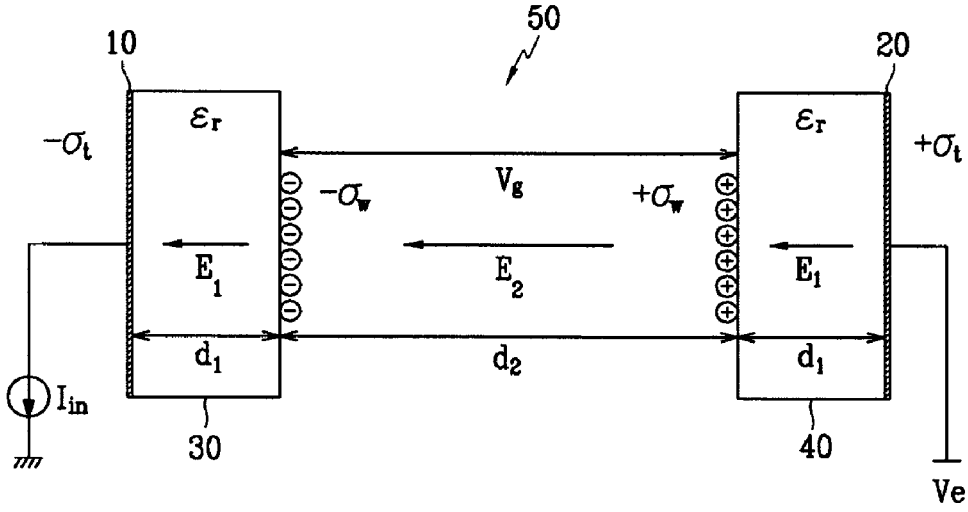
FIG. 4C shows a case when no discharge occurs in the discharge cell of FIG. 4A.
Figure 4D:
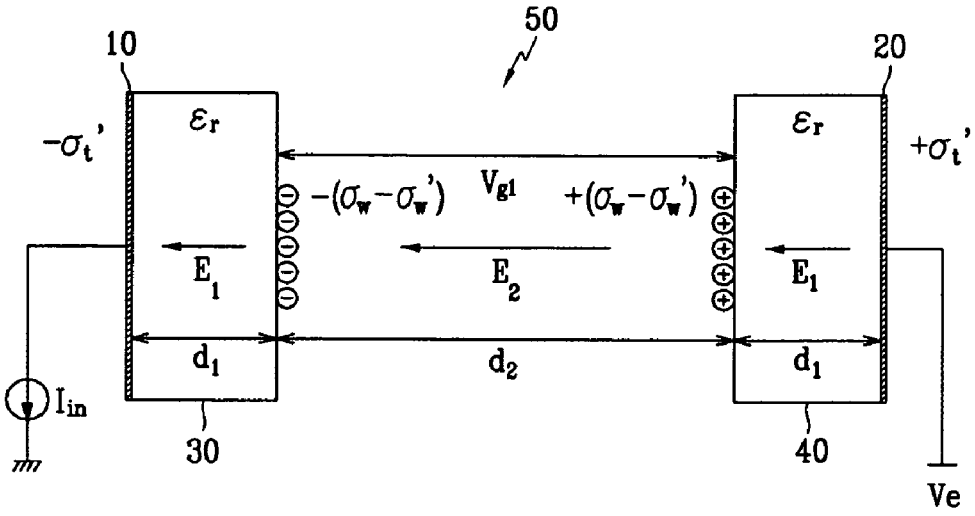
FIG. 4D shows a state that a voltage is applied when a discharge occurs in the discharge cell of FIG. 4A.
Figure 4E:
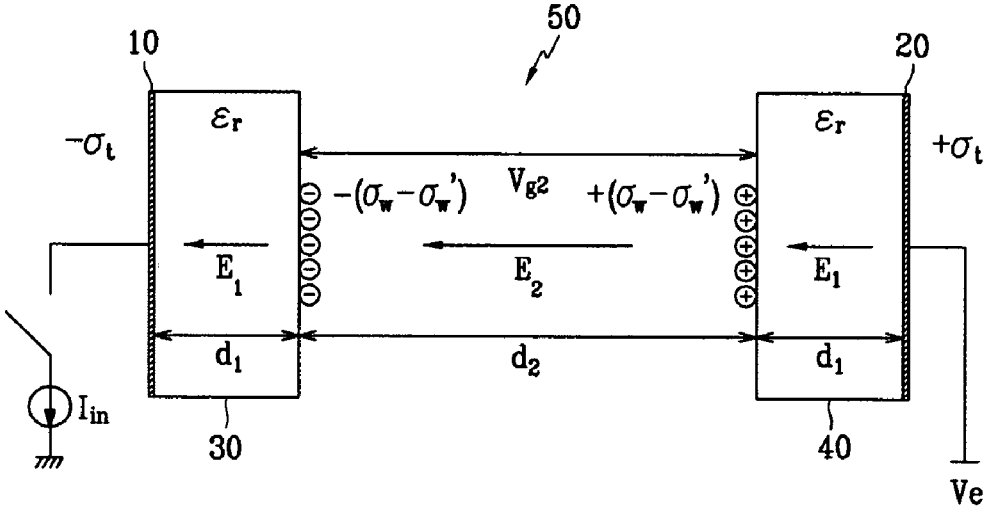
FIG. 4E shows a floated state when a discharge occurs in the discharge cell of FIG. 4A.

FIG. 4A shows a modeled diagram of a discharge cell formed by a sustain electrode and a scan electrode. FIG. 4B shows an equivalent circuit of FIG. 4A, and FIG. 4C shows a case when no discharge occurs in the discharge cell of FIG. 4A. FIG. 4D shows a state in which a voltage is applied when a discharge occurs in the discharge cell of FIG. 4A, and FIG. 4E shows a floated state when a discharge occurs in the discharge cell of FIG. 4A. For ease of description, charges $-\sigma_w$ and $+\sigma_w$ are respectively formed at the Y and X electrodes 10 and 20, respectively, in an earlier stage in FIG. 4A. These charges are actually formed on a dielectric layer of an electrode, but for ease of explanation, it is described that the charges are formed at the electrode.

As shown in FIG. 4A, the Y electrode 10 is coupled to a current source Iin through a switch SW, and the X electrode 20 is coupled to the voltage Ve. Dielectric layers 30 and 40 are respectively formed within the Y and X electrodes 10 and 20. Discharge gas (not illustrated) is injected between the dielectric layers 30 and 40, and the area provided between the dielectric layers 30 and 40 forms a discharge space 50.

In this case, the Y and X electrodes 10 and 20, the dielectric layers 30 and 40, and the discharge space 50 form a capacitive load, and they are represented as a panel capacitor Cp in FIG. 4B. The dielectric constant of the dielectric layers 30 and 40 is $\epsilon_r$, a voltage at the discharge space 50 is Vg, the thickness of the dielectric layers 30 and 40 is d1, and the distance (the size of the discharge space) between the dielectric layers 30 and 40 is d2.

The voltage Vy, applied to the Y electrode, is reduced in proportion to the time when the switch SW is turned on, as given in Equation 1. That is, when the switch SW is turned on, a falling voltage is applied to the Y electrode 10.

$$Vy = Vy(0) - \frac{I_{in}}{C_p}t \qquad \text{Equation 1}$$

where Vy(0) is the Y electrode voltage Vy when the switch SW is turned on, and Cp is the capacitance of the panel capacitance Cp.

Referring to FIG. 4C, the voltage Vg applied to the discharge space 50 when no discharge occurs while the switch SW is turned on is calculated, assuming that the voltage applied to the Y electrode 10 is Vin.

When the voltage Vin is applied to the Y electrode 10, the charges $-\sigma_t$ are applied to the Y electrode 10, and the charges $+\sigma_t$ are applied to the X electrode 20. By applying the Gaussian theorem, the electric field E1 within the dielectric layers 30 and 40 and the electric field E2 within the discharge space 50 are given as Equations 2 and 3.

$$E_1 = \frac{\sigma_t}{\varepsilon_r \varepsilon_0} \qquad \text{Equation 2}$$

where $\sigma_t$ is charges applied to the Y and X electrodes, and $\epsilon_0$ is a permittivity within the discharge space.

$$E_2 = \frac{\sigma_t + \sigma_w}{\varepsilon_0} \qquad \text{Equation 3}$$

The voltage of (Ve−Vin) applied outside is given as Equation 4 according to a relation between the electric field and the distances d1 and d2, and the voltage of Vg of the discharge space 50 is given as Equation 5.

$$2d_1E_1 + d_2E_2 = V_e - V_{in} \qquad \text{Equation 4}$$

$$V_g = d_2E_2 \qquad \text{Equation 5}$$

From Equations 2, 3, 4, and 5, the charges $\sigma_t$ applied to the Y or X electrode 10 or 20 and the voltage Vg within the discharge space 50 are respectively given as Equations 6 and 7.

$$\sigma_t = \frac{V_e - V_{in} - \frac{d_2}{\varepsilon_0}\sigma_w}{\frac{d_2}{\varepsilon_0} + \frac{2d_1}{\varepsilon_r \varepsilon_0}} = \frac{V_e - V_{in} - V_w}{\frac{d_2}{\varepsilon_0} + \frac{2d_1}{\varepsilon_r \varepsilon_0}} \qquad \text{Equation 6}$$

where Vw is a voltage formed by the wall charges $\sigma_w$ in the discharge space 50.

$$V_g = \frac{\varepsilon_r d_2}{\varepsilon_r d_2 + 2d_1}(V_e - V_{in} - V_w) + V_w = \alpha(V_e - V_{in}) + (1-\alpha)V_w \qquad \text{Equation 7}$$

Since the length d2 of the discharge space 50 is a very large value compared to the thickness d1 of the dielectric layers 30 and 40, $\alpha$ almost reaches 1. In other words, Equation 7 shows that the externally applied voltage of (Ve−Vin) is applied to the discharge space 50.

Next, referring to FIG. 4D, the voltage Vg1 within the discharge space 50 when the wall charges formed at the Y and X electrodes 10 and 20 are quenched by the amount of $\sigma'_w$ because of the discharge caused by the externally applied voltage of (Ve−Vin) is calculated. The charges applied to the Y and X electrodes 10 and 20 are increased to $\sigma'_t$ since the charges are supplied from the power Vin so as to maintain the potential of the electrodes when the wall charges are formed.

By applying the Gaussian theorem in this instance, the electric field E1 within the dielectric layers 30 and 40 and the electric field E2 within the discharge space 50 are given as Equations 8 and 9.

$$E_1 = \frac{\sigma'_t}{\varepsilon_r \varepsilon_0} \qquad \text{Equation 8}$$

$$E_2 = \frac{\sigma'_t + \sigma_w - \sigma'_w}{\varepsilon_0} \qquad \text{Equation 9}$$

From Equations 4, 5, 8, and 9, the charges $\sigma'_t$ applied to the Y and X electrodes 10 and 20 and the voltage Vg1 within the discharge space are given as Equations 10 and 11.

$$\sigma'_t = \frac{V_e - V_{in} - \frac{d_2}{\varepsilon_0}(\sigma_w - \sigma'_w)}{\frac{d_2}{\varepsilon_0} + \frac{2d_1}{\varepsilon_r \varepsilon_0}} = \frac{V_e - V_{in} - V_w + \frac{d_2}{\varepsilon_0}\sigma'_w}{\frac{d_2}{\varepsilon_0} + \frac{2d_1}{\varepsilon_r \varepsilon_0}} \qquad \text{Equation 10}$$

$$V_{g1} = d_2E_2 = \alpha(V_e - V_{in}) + (1-\alpha)V_w - (1-\alpha)\frac{d_2}{\varepsilon_0}\sigma'_w \qquad \text{Equation 11}$$

Since $\alpha$ is almost 1 in Equation 11, very little voltage falling is generated within the discharge space 50 when the voltage Vin is externally applied to generate a discharge. Therefore, when the amount $\alpha'_w$ of the wall charges quenched by the discharge is very large, the voltage Vg1 within the discharge space 50 is reduced, and the discharge is quenched.

Next, referring to FIG. 4E, the voltage Vg2 is calculated, where Vg2 is the voltage within the discharge space 50 when the switch SW is turned off (i.e., the discharge space 50 is floated) after the wall charges formed at the Y and X electrodes 10 and 20 are quenched by the amount of $\sigma'_w$ because of the discharge caused by the externally applied voltage Vin. Since no external charges are applied, the charges applied to the Y and X electrodes 10 and 20 become $\sigma_t$ in the same manner of FIG. 4C. By applying the Gaussian theorem, the electric field E1 within the dielectric layers 30 and 40 and the electric field E2 within the discharge space 50 are given as Equations 2 and 12.

$$E_2 = \frac{\sigma_t + \sigma_w - \sigma'_w}{\varepsilon_0} \quad \text{Equation 12}$$

From Equations 12 and 6, the voltage Vg2 of the discharge space 50 is given as Equation 13.

$$V_{g2} = d_2 E_2 = \alpha(V_e - V_{in}) + (1-\alpha)V_w - \frac{d_2}{\varepsilon_0}\sigma'_w \quad \text{Equation 13}$$

It is known from Equation 13 that a big voltage falling is generated by the quenched wall charges when the switch SW is turned off (floated). That is, as known from Equations 12 and 13, the voltage falling intensity caused by the wall charges in the floated state of the electrode becomes larger by a multiple of $1/(1-\alpha)$ times than that of the voltage applied state. As a result, since the voltage within the discharge space 50 is substantially reduced in the floated state when a small amount of charges are quenched, the voltage between the electrodes becomes below the discharge firing voltage, and the discharge is steeply quenched. That is, floating the electrode after the discharge starts functions as a steep discharge quenching mechanism. When the voltage within the discharge space 50 is reduced, the voltage Vy at the floated Y electrode is increased by a predetermined voltage as shown in FIG. 3 since the X electrode is fixed at the voltage of Ve.

Referring to FIG. 3, when the Y electrode is floated in the case that the Y electrode voltage falls to cause a discharge, the discharge is quenched while the wall charges formed at the Y and X electrodes are a little quenched according to the discharge quenching mechanism. By repeating this operation, the wall charges formed at the Y and X electrodes are erased step by step to thereby control the wall charges to reach a desired state. That is, the wall charges are accurately controlled to achieve a desired wall charge state in the falling ramp period Pr3 of the reset period Pr.

Figure 5:
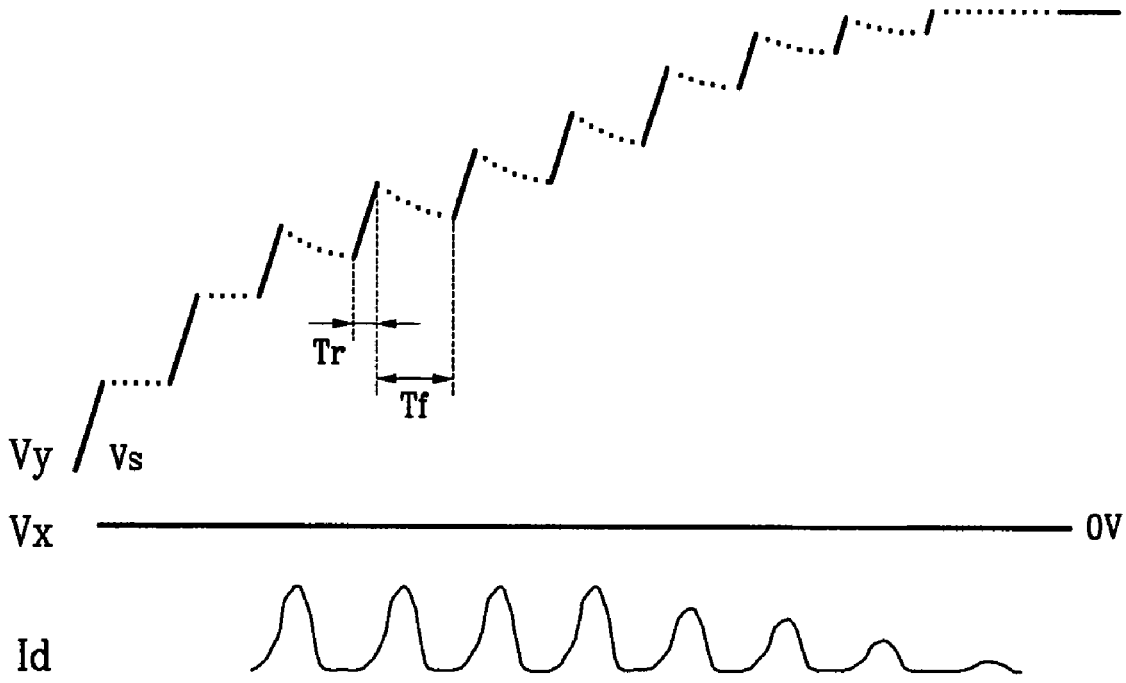
FIG. 5 shows a falling ramp waveform and a discharge current according to the exemplary embodiment of the present invention.

An exemplary embodiment of the present invention is described during the falling ramp period Pr3 of the reset period Pr, but the present invention is also applicable to cases of controlling the wall charges by using the falling ramp waveform, as well as to cases of controlling the wall charges by using the rising ramp waveform. With reference to FIG. 5, a case of applying a floating method during the rising ramp period Pr2 will be described.

FIG. 5 shows a falling ramp waveform and a discharge current according to an exemplary embodiment of the present invention.

As shown in FIGS. 2 and 5, in the rising ramp period Pr2 of the reset period Pr, a rising/floating voltage for repetitiously increasing the voltage from Vs to Vset by a predetermined voltage and a float of the Y electrode can be applied to the Y electrode while the X electrodes are maintained at 0V. That is, the voltage applied to the Y electrode is quickly increased by a predetermined amount during the period of Tr, and stopped during the period of Tf, thereby floating the Y electrode. These periods Tr and Tf are then repeated.

When the difference between the voltage Vy at the Y electrode and the voltage Vx at the X electrode becomes greater than the discharge firing voltage Vf while repeating periods Tr and Tf, a discharge occurs between the X and Y electrodes. When the Y electrode is floated after the discharge between the X and Y electrodes fires, the voltage within the discharge space is substantially reduced, and a strong discharge quenching occurs in the discharge space. Positive charges are formed at the X electrode, and negative charges are formed at the Y electrode because of the discharge between the X and Y electrodes. In this instance, the voltage Vy at the floated Y electrode is reduced by a predetermined voltage since the voltage within the discharge space is reduced as described above.

When the rising voltage is applied to the Y electrode to form a discharge and the Y electrode is then floated, wall charges are formed and a strong discharge quenching is generated within the discharge space. When this rising voltage and floating are repeated a predetermined number of times, desired amounts of wall charges are formed at the X and Y electrodes. It is desirable for the period Tr, during which the rising voltage is applied, to be short so as to appropriately control the wall charges as described above.

By repeating the operation of applying the voltage in the rising or falling ramp waveform and floating the electrode, the wall charges are appropriately controlled as desired. Therefore, it is required to provide a driving circuit for periodically performing voltage application and floating to the address driver 300, the X electrode driver 400, and the Y electrode driver 500. The driving circuit will be described in detail referring to FIGS. 6 and 8.

Figure 6:
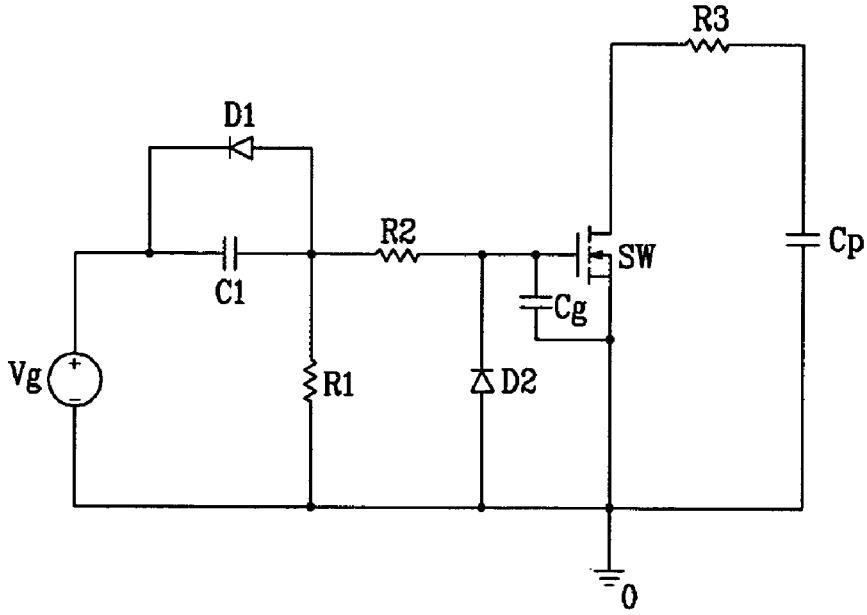
FIGS. 6 and 8 respectively show a brief circuit diagram of a driving circuit according to a first exemplary embodiment and a second exemplary embodiment of the present invention.
Figure 7:
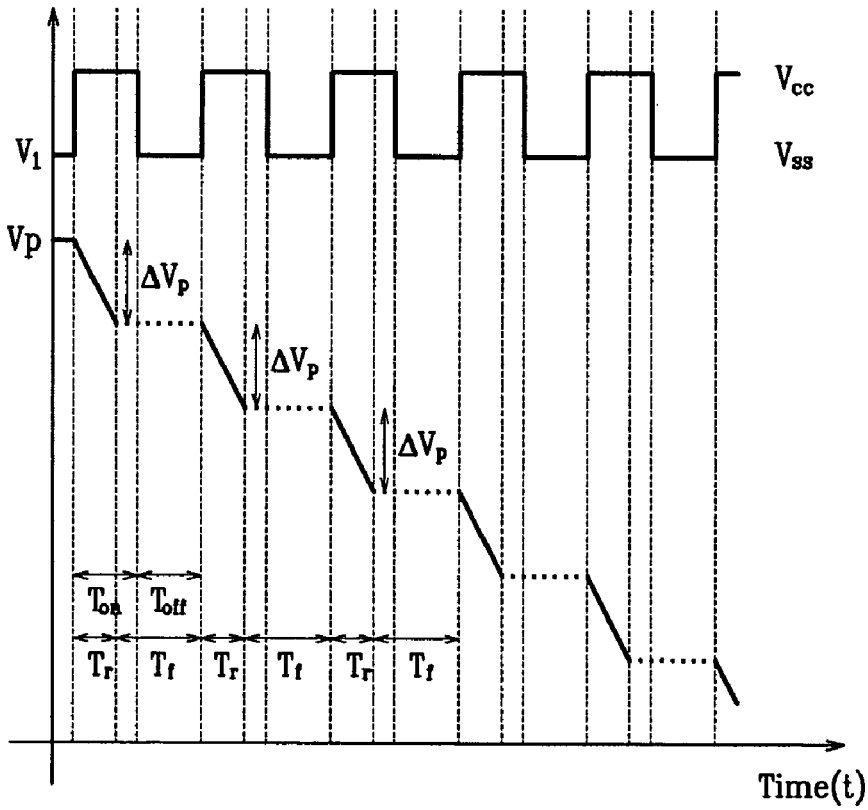
FIGS. 7 and 9 respectively show a driving waveform diagram for the driving circuit of FIGS. 6 and 8.

Referring to FIGS. 6 and 7, a driving circuit for generating a falling ramp waveform will be described.

FIG. 6 shows a brief circuit diagram of the driving circuit according to the first exemplary embodiment of the present invention, and FIG. 7 shows a driving waveform diagram of the driving circuit of FIG. 6. A panel capacitor Cp of FIG. 6 forms a capacitive load between the Y and X electrode as shown in FIG. 4A. It is assumed that a ground voltage is applied to a second end of the panel capacitor Cp, and that the panel capacitor Cp is charged with a predetermined amount of charges.

As shown in FIG. 6, the driving circuit according to the first exemplary embodiment comprises a transistor SW, a capacitor C1, and a control signal voltage source Vg. The control signal voltage source Vg, coupled between the gate of the transistor SW, applies a control signal V1 to the transistor SW. A drain of the transistor SW is coupled to a first end of the panel capacitor Cp, and its source is coupled to the ground 0. A parasitic capacitance Cg is formed between the gate and the source of the transistor SW. The capacitor C1 is coupled between a gate of the transistor SW and the control signal voltage source Vg, and a resistor R1 is coupled between the capacitor C1 and the source of the transistor SW. The capacitor C1 and the resistor R1 form an RC circuit to function as a gate voltage control circuit for controlling the gate voltage of the transistor SW.

A resistor R2, or an inductor, can be additionally formed between the capacitor C1 and the transistor SW. A diode D2 can be formed between the source and the gate of the transistor SW to perform clamping so that the gate voltage of the transistor SW may not be less than a reference voltage of the control signal voltage source Vg. Also, a diode D1 may be formed in parallel with the capacitor C1 to perform clamping so that the gate voltage of the transistor SW may not be greater than the voltage of the control signal voltage source Vg.

Next, an operation of the driving circuit of FIG. 6 is described with reference to FIG. 7. Operations of the resistor R2 and the diodes D1 and D2 will be omitted, and it is assumed that no discharge is generated in the waveform of FIG. 7 for ease of description. If a discharge occurs, the waveform of FIG. 7 will be given such that the voltage of Vp is increased in the floating period as shown in the waveform of FIG. 3.

As shown in FIG. 7, the control signal V1 supplied by the control signal voltage source Vg alternately has a high-level voltage Vcc, during the period Ton, for turning on the transistor SW, and a low-level voltage Vss, during the period Toff, for turning off the transistor SW.

When the control signal V1 becomes the high-level voltage Vcc so as to turn on the transistor SW, the capacitor C1, the resistor R1, a capacitance component Cg of the transistor SW, and a gate voltage V2(t) of the transistor SW satisfy Equation 14.

$$C_1\frac{dV_2(t)}{dt}+\frac{V_2(t)}{R_1}+C_g\frac{V_2(t)}{dt}=0 \qquad \text{Equation 14}$$

where C1 and Cg are capacitances of the capacitor C1 and the capacitance component Cg, and R1 is a resistance value of the resistor R1.

When the control signal V1 becomes the high-level, that is, when t=0, the gate voltage V2(0) of the transistor SW corresponds to Vcc, and hence, the gate voltage V2(t) of Equation 14 leads to Equation 15.

$$V_2(t)=\frac{C_1}{C_1+C_g}V_{cc}e^{-\frac{1}{R_1(C_1+C_g)}t} \qquad \text{Equation 15}$$

The transistor SW is turned on when the gate-source voltage is greater than the threshold voltage Vt of the transistor SW, and the gate-source voltage of the transistor SW corresponds to the gate voltage V2(t). Therefore, since the relation between the gate voltage V2(t) and the threshold voltage Vt of the transistor SW satisfies Equation 16, the period Tr in which the transistor SW is turned on is given as Equation 17.

$$\frac{C_1}{C_1+C_g}V_{cc}e^{-\frac{1}{R_1(C_1+C_g)}t}>V_t \qquad \text{Equation 16}$$

$$T_\gamma=R_1(C_1+C_g)\ln\frac{C_1V_{cc}}{V_t(C_1+C_g)} \qquad \text{Equation 17}$$

In this instance, the panel capacitor Cp is discharged, and the voltage Vp of the panel capacitor Cp is reduced during the period Tr in which the transistor SW is turned on. That is, the voltage falling period of the panel capacitor Cp corresponds to the turned-on period Tr of the transistor SW. The amount ΔVp of the reduced voltage Vp at the panel capacitor Cp is determined by the period Tr in which the transistor SW is turned on, and it is desirable for the voltage falling period Tr to be short so as to precisely control the amount of the wall charges. There is a limit in making the turn-on time of the transistor SW short by only using the control signal V1, but it is possible to make the period Tr for turning on the transistor SW shorter than the high-level period Ton of the control signal V1.

When the period Tr expires, the gate voltage V2(t) of the transistor SW becomes less than the threshold voltage Vt, and the transistor SW is turned off even though the control signal V1 is a high-level voltage Vcc. When the control signal V1 becomes a low-level voltage Vss, the transistor SW maintains the turned-off state. When the transistor SW is turned off as described above, the first end of the panel capacitor Cp becomes floated. The floating period Tf is defined as a period from a time when the gate voltage V2(t) of the transistor SW becomes less than the threshold voltage Vt to a time when the control signal V1 is maintained at the low-level voltage Vss.

When the control signal V1 becomes the high-level voltage Vcc again, the transistor SW is turned on, and the voltage Vp at the panel capacitor Cp falls. When the gate voltage of the transistor SW falls as shown in Equation 14, and becomes less than the threshold voltage of the transistor SW, the transistor SW is turned off. When the control signal V1 becomes the low-level voltage Vss, the transistor SW maintains the turn-off state. The period Tr in which the voltage Vp at the panel capacitor Cp falls in response to the high-level voltage Vcc of the control signal V1, and the period Tf in which the panel capacitor Cp floats according to reduction of the gate voltage V2(t) of the transistor SW are repeated, and accordingly, the falling ramp voltage for repeating voltage falling and floating is applied to the electrode.

Since the period Tr in which the transistor SW is turned on is determined by the resistor R1 and the capacitor C1 in Equation 17, the turn-on period Tr is controlled by the resistor R1 and the capacitor C1. In particular, the resistor R1 can be a variable resistor to establish the turn-on period Tr. For example, when the resistance of the resistor R1 is increased, the turn-on period Tr of the transistor SW becomes longer, and the reduction amount ΔVp of the voltage Vp of the panel capacitor Cp becomes greater. The gate voltage of the transistor SW can be controlled by using an inductor instead of the resistor R1. Also, a resistor R3, or an inductor, can be formed between the drain of the transistor SW and the panel capacitor Cp to thereby control the current discharged from the panel capacitor Cp.

Figure 8:
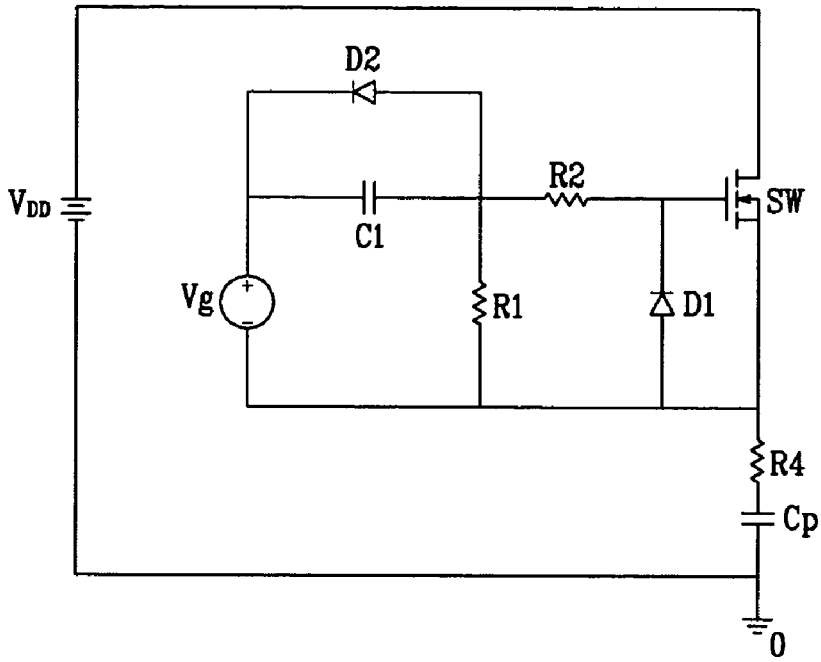

The driving circuit for generating the falling ramp voltage for repeating voltage falling and floating is described in a first exemplary embodiment. In another exemplary embodiment, a driving circuit for generating a rising ramp voltage for repeating voltage rising and floating will be described with reference to FIG. 8. Since the configuration and the operation of the circuit of FIG. 8 is similar to those of the first exemplary embodiment, differences from the first embodiment will be described, and the same portion or those which can be easily known from the first exemplary embodiment will be omitted. Modifications of the circuit of FIG. 6 noted above can also be applied to the circuit of FIG. 8.

Figure 9:
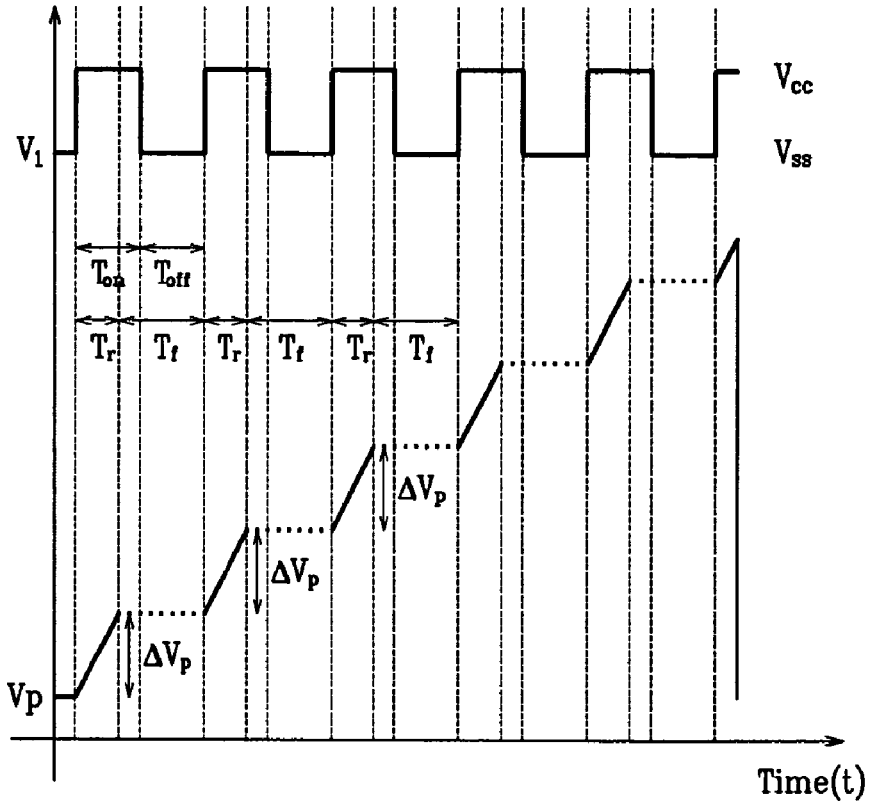

FIG. 8 shows a brief circuit diagram of the driving circuit according to the second exemplary embodiment of the present invention, and FIG. 9 shows a driving waveform diagram caused by the driving circuit of FIG. 8. For ease of description, it is assumed in FIG. 9 that no discharge is generated in the same manner as described in FIG. 7.

As shown in FIG. 8, unlike FIG. 6, the panel capacitor Cp is coupled to the source of the transistor SW, and the drain of the transistor SW is coupled to the power source $V_{DD}$, which supplies a voltage greater than that of the first end of the panel capacitor Cp. Other components are coupled in the same manner of the first exemplary embodiment, except for the optional resistor R4, or an inductor, utilized to control the current discharged from the panel capacitor Cp, which can be formed between the panel capacitor Cp and the first main end of the transistor.

The panel capacitor Cp is charged by the power source $V_{DD}$ during the period Tr in which the control signal V1 becomes the high-level voltage Vcc and the transistor SW is turned on as described in the first exemplary embodiment. In this instance, ΔVp, which is the change in the voltage Vp of the panel capacitor Cp, increases proportionally to the turn-on period Tr of the transistor SW.

When the gate voltage V2(t) of the transistor SW is reduced by the RC circuit formed by the capacitor C1 and the resistor R1, and the gate-source voltage of the transistor SW becomes lower than the threshold voltage Vt of the transistor SW, the transistor SW is turned off. When the control signal V1 becomes the low-level voltage Vss, the transistor SW maintains the turn-off state. The period in which the transistor SW is turned off is the period Tf, during which the panel capacitor Cp is floated.

As shown in FIG. 9, when the control signal V1 alternately has high-level voltages Vcc, during the period Ton, and low-level voltages Vss, during the period Toff, the operation where the voltage at the panel capacitor Cp rises by a predetermined amount of ΔVp and the panel capacitor Cp is floated is repeated, and the amount of the charge formed at the panel capacitor Cp is controlled as desired.

Methods of floating the scan electrode are mainly described in the above-noted embodiments, and in addition, methods of floating one of the electrodes at a discharge cell including a scan electrode, a sustain electrode, and an address electrode can also be used.

According to the present invention, a driving circuit for repeating the operation for floating the electrode after making the voltage applied to the electrode rise or fall is provided, and the wall charges formed at the discharge cell are finely controlled by the above operation.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A device for driving a plasma display panel (PDP), comprising:

a transistor having a first main end coupled to a capacitive load, a second main end coupled to a power source, and a control end;

a control end voltage control circuit coupled between a control signal voltage source and the control end of the transistor;

wherein the control signal voltage source alternately generates a control signal of a first level and a second level, and transmits the control signal to the control end voltage control circuit, wherein the control end voltage control circuit, in response to the control signal of the first level, applies a first voltage to the control end of the transistor to turn on the transistor, and then changes the voltage to the control end of the transistor to a second voltage for turning off the transistor within a predetermined period after the control signal of the first level is applied, and wherein the predetermined period is shorter than a period in which the control signal is maintained at the first level.

2. The device of claim 1, wherein the control end voltage control circuit comprises:

a capacitor coupled between the control signal voltage source and the control end of the transistor, and a first resistor or a first inductor coupled between the capacitor and the second main end of the transistor.

3. The device of claim 2, wherein the control end voltage control circuit further comprises a second resistor or a second inductor coupled between the capacitor and the control end of the transistor.

4. The device of claim 2, wherein the resistor is a variable resistor.

5. The device of claim 1, further comprising a resistor or an inductor between the capacitive load and the first main end of the transistor.

6. A method for driving a plasma display panel, comprising:

applying a first voltage to a control end of a transistor that turns on the transistor in response to a control signal of a first level;

changing the first voltage at the control end of the transistor to a second voltage at the control end of the transistor that turns off the transistor within a predetermined period after the control signal of the first level is applied; and applying a third voltage to the control end of the transistor for maintaining the transistor in a turned off state in response to the control signal of a second level, wherein the control signal alternately has the first level and the second level, and wherein the predetermined period is shorter than a period in which the control signal is maintained at the first level.

7. The method of claim 6, wherein when the transistor turns off, the control signal is still at the first level.

8. The method of claim 6, wherein the control end voltage of the transistor is changed through a circuit including a resistor and a capacitor formed to function as a control end voltage control circuit.

9. The method of claim 6, wherein:

the transistor is coupled between a capacitive load and a power source, and the voltage of the capacitive load is decreased due to a potential difference between the capacitive load and the power source when the transistor is turned on.

10. The method of claim 6, wherein:

the transistor is coupled between a capacitive load and a power source, and the voltage of the capacitive load is increased due to a potential difference between the capacitive load and the power source when the transistor is turned on.

11. A plasma display panel apparatus including a driver for driving the plasma display panel formed with a capacitive load between at least two electrodes, the driver comprising:

a transistor coupled between the capacitive load and a power source; and a control circuit coupled to a control end of the transistor, and receiving a control signal that alternately has a first level and a second level, wherein the control circuit turns on the transistor in response to the control signal of the first level, and turns off the transistor within a predetermined period after the control signal of the first level is applied by changing the control end voltage of the transistor while the control signal maintains the first level, and wherein the predetermined period is shorter than a period in which the control signal is maintained at the first level.

12. The plasma display panel apparatus of claim 11, wherein the control circuit comprises a resistor and a capacitor.

* * * * *